US009761955B2

(12) United States Patent
Merk

(10) Patent No.: US 9,761,955 B2
(45) Date of Patent: Sep. 12, 2017

(54) FEED NETWORK FOR ANTENNA SYSTEMS HAVING MICROSTRIP CONDUCTOR LOOPS

(71) Applicant: Lisa Draexlmaier GmbH, Vilsbiburg (DE)

(72) Inventor: Thomas Merk, Stuttgart (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 14/838,555

(22) Filed: Aug. 28, 2015

(65) Prior Publication Data

US 2016/0064796 A1 Mar. 3, 2016

(30) Foreign Application Priority Data

Aug. 29, 2014 (DE) ..... 10 2014 112 467

(51) Int. Cl.

| | |
|---|---|
| ***H01Q 21/00*** | (2006.01) |
| ***H01Q 21/06*** | (2006.01) |
| ***H01P 5/12*** | (2006.01) |
| ***H01P 5/107*** | (2006.01) |
| ***H01P 5/19*** | (2006.01) |

(Continued)

(52) U.S. Cl.

CPC ..... *H01Q 21/0037* (2013.01); *H01P 3/081* (2013.01); *H01P 3/12* (2013.01); *H01P 5/02* (2013.01); *H01P 5/107* (2013.01); *H01P 5/12* (2013.01); *H01P 5/19* (2013.01); *H01Q 21/0075* (2013.01); *H01Q 21/065* (2013.01); *H01Q 13/02* (2013.01)

(58) Field of Classification Search

CPC .. H01P 5/107; H01P 5/10; H01P 5/123; H01P 5/12; H01Q 13/22; H01Q 21/0037; H01Q 21/065; H01Q 21/0075

USPC ..... 333/26, 137, 125; 343/771

See application file for complete search history.

(56) References Cited

U.S. PATENT DOCUMENTS 3,286,202 A 11/1966 Daveau
3,389,350 A * 6/1968 Sanner et al. ..... H01P 5/12 333/125

(Continued)

FOREIGN PATENT DOCUMENTS

DE 103 23 431 A1 1/2004
JP 2010-028345 2/2010

(Continued)

OTHER PUBLICATIONS

Vassilev, V. et al., "A New 3-dB Power Divider for Millimeter-Wavelengths," IEEE Microwave and Wireless Components Letters, vol. 11, No. 1, Jan. 2001 (4 pages).

(Continued)

*Primary Examiner* — Benny Lee

(74) *Attorney, Agent, or Firm* — Finnegan, Henderson, Farabow, Garrett & Dunner LLP

(57) ABSTRACT

A feed network for an antenna system having a waveguide is disclosed. The waveguide has broad sides facing each other and narrow sides facing each other. The feed network includes a first microstrip conductor including a first conductor loop and a second microstrip conductor including a second conductor loop. The first and second conductor loops each extend into the waveguide from one of the narrow sides and are each electrically coupled to one of the broad sides.

20 Claims, 6 Drawing Sheets

(51) Int. Cl.

| | |
|---|---|
| ***H01P 3/08*** | (2006.01) |
| ***H01P 3/12*** | (2006.01) |
| ***H01P 5/02*** | (2006.01) |
| *H01Q 13/02* | (2006.01) |

(56) References Cited

U.S. PATENT DOCUMENTS

| | | | | |
|---|---|---|---|---|
| 3,432,716 | A * | 3/1969 | Tanaka et al. | H01J 25/40 315/3.5 |
| 6,061,026 | A | 5/2000 | Ochi et al. | |
| 6,201,453 | B1 | 3/2001 | Chan et al. | |
| 7,436,371 | B1 * | 10/2008 | Paulsen | H01Q 13/22 343/770 |
| 2004/0183620 | A1 * | 9/2004 | Scorer | H01P 5/103 333/26 |
| 2006/0181365 | A1 * | 8/2006 | Baird | H01P 5/107 333/26 |

FOREIGN PATENT DOCUMENTS

| | | | |
|---|---|---|---|
| WO | WO 2014/005693 | A1 | 1/2014 |
| WO | WO 2014/005699 | A1 | 1/2014 |

OTHER PUBLICATIONS

Buoli, C. et al., "Microstrip to waveguide 3dB power splitter/combiner on FR4 PCB up to 50 GHz," 2005 European Microwave Conference, Oct. 2005 (4 pages).

* cited by examiner

FEED NETWORK FOR ANTENNA SYSTEMS HAVING MICROSTRIP CONDUCTOR LOOPS

CROSS-REFERENCE TO RELATED APPLICATION

This application is based upon and claims the benefit of prior German Application No. 10 2014 112 467.7, filed on Aug. 29, 2014, the entire contents of which are incorporated herein by reference.

TECHNICAL FIELD

The present disclosure relates to a feed network with a waveguide and two microstrip conductors for antenna systems, in particular for bidirectional satellite communication operated in the Ka, Ku or X band, for mobile and aeronautic applications.

BACKGROUND

In order to connect aircraft to a satellite network for the transmission of multimedia data, wireless broadband channels for data transmission with very high data rates are needed. For this purpose, antennas need to be installed on the aircraft, which have small dimensions for installation under a radome and nevertheless satisfy extreme requirements in terms of the transmission characteristic for an oriented wireless data communication with the satellite (for example, in the Ku, Ka or X band), since any interference with neighboring satellites has to be reliably ruled out.

The antenna is moreover movable under the radome, in order to update the orientation to the satellites as the aircraft moves. For this purpose, the antenna has to be constructed compactly to remain movable under the radome.

The regulatory requirements pertaining to the transmission operation result from international standards. All these regulatory specifications are intended to ensure that no interference with neighboring satellites can occur in the oriented transmission operation of a mobile satellite antenna.

WO2014005693 and WO2014005699, for example, show solutions for compact antennas for applications in satellite communications. These antennas consist of antenna arrays that are constructed from individual radiators and have suitable feed networks. They can be implemented in different geometries and different length to side ratios, while ensuring high antenna efficiency. In particular, antenna arrays with small installation height can be produced.

WO2014005699 discloses feed networks that can be produced from a combination of waveguides and microstrip lines. The disclosure provides an antenna system comprising microstrip conductor arrangements for feeding individual horn radiators within a module. However, the disclosure suffers from several drawbacks. For example, when the horn radiators are densely packed in antenna arrays, efficient feed networks have to be accommodated in the installation space available behind the horn radiator array. Here, the number of the power dividers required is high. The power dividers in the waveguide area of the feed network require installation space, which is limited.

The feed networks shown in WO2014005699 make it possible to distribute, in the case of signal transmission, a sum signal with correct amplitude and phase over the individual radiators or conversely, in the case of receiving, to add the signals of the individual radiators correctly to a sum signal. The feed network consists of microstrip conductors, which cluster individual radiator groups, and consists of a waveguide network, again to cluster several groups.

Microstrip conductors have the advantage of requiring little space, and thus they allow a high integration density. The disadvantage consists of higher electrical losses compared to waveguides which, however, require a considerably larger volume compared to microstrip conductors.

In order to keep the weight and the rotation volume of an antenna as small as possible for a given aperture surface area, there is a need for minimizing the number of the waveguide sections or the total volume of the waveguide without having to accept trade-offs in the electrical performance of the antenna.

SUMMARY OF THE INVENTION

Embodiments of the present disclosure provide a feed network with a coupling between waveguide and microstrip line, which allows a high degree of flexibility for the power coupling and a small installation height.

The feed network consistent with embodiments of the present disclosure includes a waveguide with broad sides and narrow sides, as well as two microstrip conductors each including a conductor loop. The conductor loops each extend into the waveguide from one of the narrow sides and are electrically connected to a broad side of the waveguide, i.e., the conductor loops are short-circuited with the waveguide on the broad sides. On each narrow side, the waveguide has a small opening through which the microstrip conductor is led without being in electrical contact with the waveguide on the narrow side.

This results in the possibility of an inductive H field coupling, which has a low sensitivity to tolerance-caused mechanical displacements of microstrip conductors relative to the waveguide, which differs from the otherwise usual capacitive E field couplings. By using two conductor loops, it is possible, with about identical electrical losses, to decouple simultaneously for two signal paths and thus to reduce the number of power dividers in the waveguide by half. The number of coupling sites of a strip line on the waveguide can be minimized according to the present disclosure. Thus, the installation size of the feed network is reduced. This simplification of a waveguide feed network formed by the waveguides thus contributes greatly to reducing weight and volume of an antenna in which the feed network according to the present disclosure is used.

In some embodiments, the conductor loops extend into the waveguide from narrow sides that face each other. As a result, the microstrip conductors, given their own feed networks and with low-loss short paths, can connect a large number of antenna elements, for example, via additional microstrip power dividers.

The H field coupling of a waveguide and two microstrip conductors results in a power divider for the signals that arrive via the waveguide. This provides a type of "hybrid" power divider, which distributes the signal from a waveguide to two microstrip conductors.

In some embodiments, the conductor loops have an equal length within the waveguide. As a result, the signals on the two microstrip lines have the same phase shift, and no additional phase equalization is required at the time of the activation of the successive antenna elements.

In some embodiments, the conductor strips are arranged so that they extend into the waveguide from the narrow sides in the center. In this manner a maximum power can be coupled into the microstrip conductor, and the adaptation at the transition can be optimized. The arrangement of the microstrip conductor in the waveguide occurs, for example, approximately λ/4 from an end of the short-circuited waveguide.

According to embodiments of the present disclosure, there is also provided an asymmetric power divider, in which the electrical connections of the two conductor loops to the broad side of the waveguide are spaced differently from a midpoint of the broad side. This results in different sizes of loop surface areas for the two conductor loops that are permeated by the magnetic field. The ratio of the surface areas of the two conductor loops permeated by the magnetic field, which is thus set, determines the power divider ratio. For broadband it is thus possible to adjust divider ratios from 50:50 to 80:20, as a result of which the desired aperture configuration of the antenna is easily realizable.

Moreover, one of the microstrip conductors of the feed network can comprise a phase equalization arc, which adapts the length of this microstrip conductor to the length of the other microstrip conductor, leading thus, in spite of the asymmetry in the conductor loop shape, to an equal microstrip conductor length and thus an equal phase shift of the signals of the two microstrip conductors. In some embodiments, the phase equalization arc is associated with the microstrip conductor that is electrically connected to the waveguide at a greater distance from the midpoint of the broad side than the other microstrip conductor.

If the electrical connection of the microstrip lines occurs on different broad sides of the waveguide, then, with no further expenditure, a 180° phase shift between the signals of the two conductor loops is set. This can be used for the compensation of geometrically mirrored antenna elements or for the equalization of possible phase shifts of successive waveguide networks.

For the impedance matching of the microstrip conductors to the waveguide, in some embodiments, the conductor loops do not have a straight shape, comprising instead width changes and offset parts. By defining the position and size of width changes and offset parts, the reflections are reduced for the desired frequency range.

In some embodiments, in the feed network, Suspended Strip Line (SSL) microstrip conductors are used in order to keep the losses low. The microstrip conductors include a printed circuit board with a dielectric, which has a thickness of about 0.1 to 1 mm, such as about 0.127 mm, and a copper strip with a thickness of about 15 to 50 μm, such as about 17.5 μm, arranged on the printed circuit board. The width of the copper strip here is about 0.2 to 3 mm, such as 0.5 mm.

In some embodiments, the waveguide or the waveguide network is implemented at least in some sections as a ridge waveguide. The ridge waveguide allows a more broad-band frequency range than a "normal" rectangular waveguide, which is of particular interest for the Ka band. Moreover, a ridge waveguide allows more compact designs (reduction of the broad side) compared to a "normal" rectangular waveguide with the same cutoff frequency (which is also of interest in the case of lower frequencies (X band and Ku band)), in which the waveguide dimensions would otherwise be greater.

In some embodiments, the electrical connection of the conductor loops to the broad side of the waveguide is galvanic—direct connection of a conductor path of the microstrip line and of the waveguide edge, or is capacitive. In the case of a capacitive connection, the waveguide contains an opening into which a printed circuit board with the conductor loops is inserted. For the formation of a capacitance, the conductor paths of the two sides of the printed circuit board are connected to one another by vias and separated from the waveguide by insulation. The thickness of the insulation and the surface area of the conductor paths which are insulated from the waveguide here determine the capacitance.

For a compact design, a distance from one end of the waveguide to the microstrip conductor is, for example, about λ/8 to λ/12, which is less than λ/4, for which a maximum field strength would exist. It has been shown that, with reasonable losses, the installation size of the feed network can thus be further reduced.

The waveguide of the feed network can comprise restrictions, as a result of which a ridge waveguide is formed. In some embodiments, the electrical connection of the conductor loops to the broad side of the waveguide does not contact any restriction, but occurs instead in a rectilinear section.

In some embodiments, the feed network provides an asymmetric power division, which is produced by the conductor loops framing a different surface area. For an impedance adaptation, in the conductor loop with the greater power decoupling, the width of the microstrip line is greater than that in the other conductor loop having smaller power decoupling.

According to embodiments of the present disclosure, feed network in the frame of an antenna having several horn radiators as antenna elements can be realized. The antenna elements are connected via microstrip conductors to a waveguide which has broad sides and narrow sides. The microstrip conductors each include a conductor loop which extends into the waveguide from one of the narrow sides and which is electrically connected to a broad side of the waveguide. Horn radiators are efficient individual radiators which are arranged in antenna arrays. In addition, horn radiators can be designed for broadband.

As a result, the antenna is suitable for a bidirectional operation in vehicle-based satellite communication in a frequency band of about 7.25-8.4 GHz (X band), about 12-18 GHz (Ku band), and about 27-40 GHz (Ka band).

In addition, further advantages and features of the present disclosure can be seen in the following description of exemplary embodiments. The features described therein can be implemented separately or in combination with one or more of the above-mentioned features, provided that the features do not contradict one another. The following description of the exemplary embodiments is made here in reference to the accompanying drawings.

DETAILED DESCRIPTION OF THE INVENTION

Figure 1:
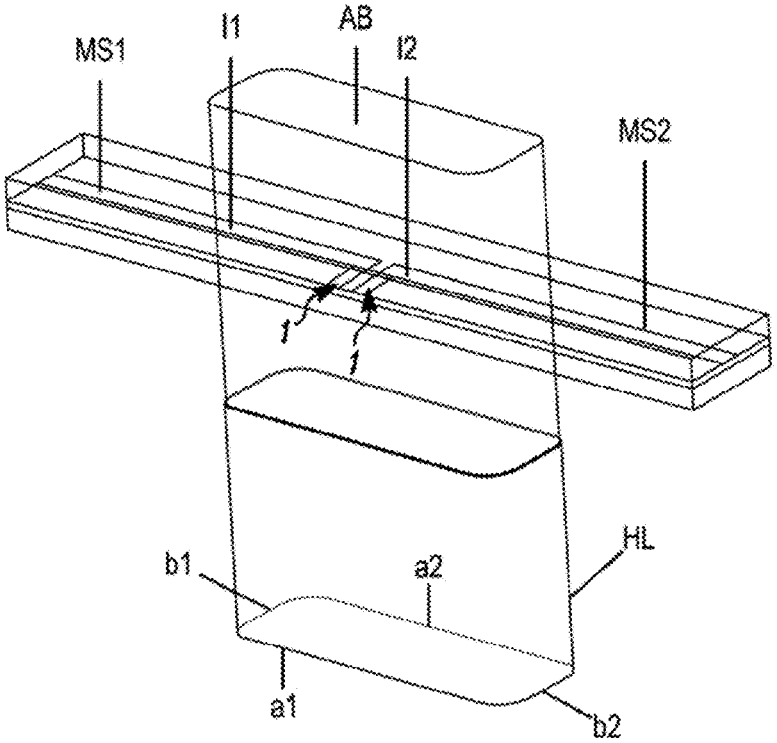
FIG. 1 shows in a 3D representation a waveguide with two coupling microstrip conductors.

FIG. 1 shows a waveguide HL, which is filled with air and has the dimensions about 16×6 mm for the Ku band or about 7×2.5 mm for the Ka band. On the upper surface of the waveguide HL, represented in FIG. 1, the waveguide is closed. The waveguide HL is shown having broad sides a1, a2 and narrow sides b1, b2. The closure at the end AB of the waveguide HL here is at a distance of approximately λ/4 from a coupling of two microstrip conductors MS1, MS2. The microstrip conductors MS1, MS2 here extend into the waveguide HL from a narrow side b1, b2. The microstrip conductors MS1, MS2 consist of a Suspended Strip Line (SSL) which consists of a printed circuit board on which a copper strip or a copper layer is applied. The printed circuit board includes a dielectric with a thickness of about 0.1 to 1 mm, such as about 0.127 mm. The copper strip located thereon has a width of about 0.2 to 3 mm, such as about 0.5 mm, and a thickness of about 15 to 50 μm, such as about 17.5 μm. To make it possible for the microstrip conductors MS1, MS2 to extend into the waveguide HL, the narrow sides b1, b2 at the level of the coupling each have a small slot which is adapted to the shape of the microstrip conductor MS1 and MS2. The SSL is enclosed by a metal. As a result, there are no power losses due to radiation out of the structure and by passing through at the slots. With proper dimensions of the slot, the interfering effect on the field of the waveguide HL remains negligible.

On a broad side a1 of the waveguide HL, the two microstrip conductors MS1, MS2 are electrically connected to the waveguide HL. This connection in each case represents a short-circuit 1 of the respective microstrip conductor MS1, MS2 with the waveguide HL. As a result, on the two sides of the waveguide HL, from the respective microstrip conductors MS1, MS2, a conductor loop /1, /2 is formed, around which an H field is generated.

Figure 2:
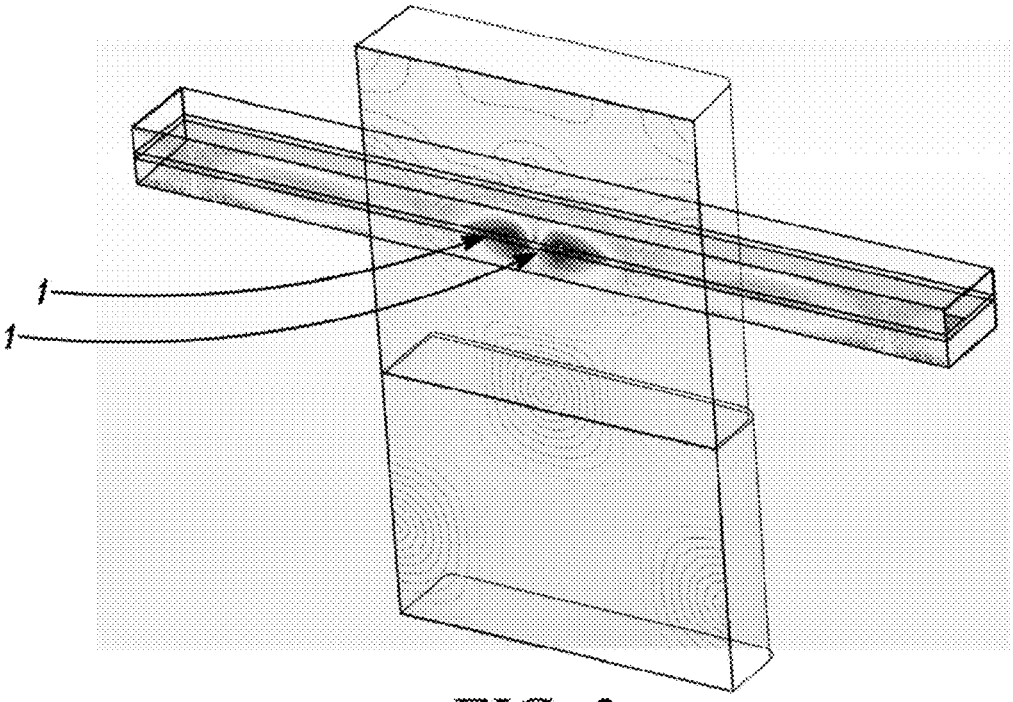
FIG. 2 shows the waveguide of FIG. 1 with field lines of an H field.

The inductive H field coupling is shown again in FIG. 2. On a section plane through the coupling, one can see at sites close to the short-circuits 1 how the H field in a TE mode is coupled from the waveguide HL into the two microstrip lines MS1, MS2 (as shown in FIG. 1) as in a TEM mode.

This principle of double H-field coupling through two microstrip conductors MS1, MS2 leads to power division from the waveguide HL to the microstrip conductors MS1, MS2. In contrast to the known coupling and decoupling, a power division here occurs already in the transition from waveguide to microstrip conductor. This reduces the need for additional power dividers, which would typically be arranged in the waveguide feed network.

Figure 3:
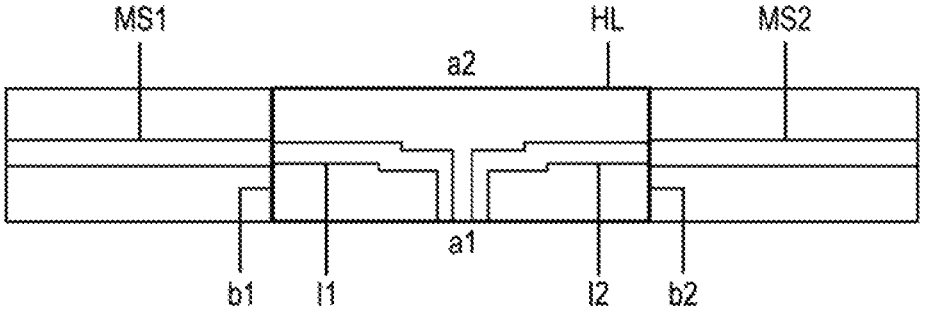
FIG. 3 shows the cross section of a waveguide with two symmetric, equal-phase microstrip conductors.
Figure 4:
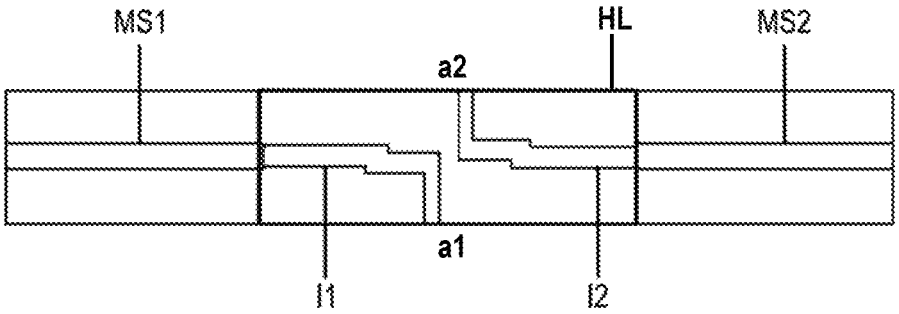
FIG. 4 shows the cross section of a waveguide with two symmetric, opposite-phase microstrip conductors.
Figure 5:
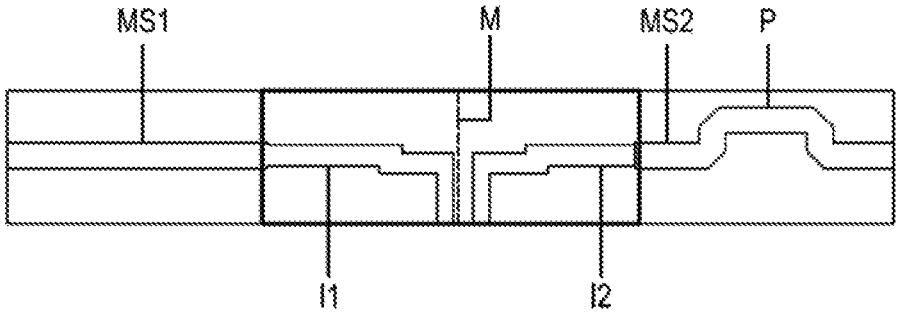
FIG. 5 shows the cross section of a waveguide with two asymmetric, equal-phase microstrip conductors.

The feed network according to the present disclosure, which includes the two microstrip conductors MS1, MS2 and the waveguide HL, is now explained further in reference to FIGS. 3 to 5.

FIG. 3 depicts a waveguide HL having broad sides a1, a2 and narrow sides b1, b2. In FIG. 3 it is shown that the conductor loops /1, /2 within the waveguide HL form two loops of equal size, which extend from the narrow sides b1 and b2 to the broad side a1. These surface areas of equal size of the conductor loops /1, /2 indicate a symmetric power division. The conductor loops /1, /2 furthermore contain width changes and offset parts (i.e. stepped portions) which promote the adaptation of the microstrip conductor MS1 and MS2 to the conditions of the waveguide HL. Here, a conductor loop piece that in each case adjoins the broad side a1 is smallest, and a conductor loop piece that represents the transition to the microstrip conductor MS1 and MS2 outside of the waveguide HL is broadest. The size and the position of the width changes and offset parts can be optimized in accordance with the desired frequency band.

The microstrip conductors MS1, MS2 continue after the slot in the narrow side b1, b2 of the waveguide HL and form microstrip conductor networks by means of which the antenna elements are supplied, as shown below.

FIG. 4 shows a variant in comparison to FIG. 3, in which the phase shift of the signals between the microstrip conductors MS1, MS2 is produced in that the electrical connections of the conductor loops /1, /2 respectively face broad sides a1 and a2 of the waveguide HL. The positioning of the conductor loops /1 and /2 here is again symmetric, but mirror-inverted with respect to the upper and lower side of the waveguide HL. This means again that a symmetric power division is achieved, but that the signals on one microstrip conductor MS1 are phase-shifted by 180° relative to the other microstrip conductor MS2.

In the feed network according to FIG. 5, a midpoint M of the broad sides of the waveguide is drawn. This makes it easier to see that an asymmetric power divider is implemented in FIG. 5. The conductor loop /1 on the left side of the waveguide here has a larger suffused surface area than the conductor loop /2 on the right side. As a result, more energy is decoupled in one conductor loop /1 than in the other conductor loop /2. The lengths of the conductor loops /1 and /2 within the waveguide are thus different. For a phase equalization, the microstrip conductor MS2 with the lower power decoupling comprises an additional phase arc P which entails a length equalization of the microstrip conductor MS2 and a matching to the length of the other microstrip conductor MS1.

As a result of the asymmetries of the power divider, see FIG. 5, divider ratios from 50:50 to 80:20 can be set. This allows for a great variety of aperture configurations for the antennas actuated by the feed network. As a result of a phase shift set between two microstrip conductors MS1, MS2, see FIG. 4, geometrically mirrored antenna elements or possible phase shifts can be compensated by successive waveguide networks.

Figure 6:
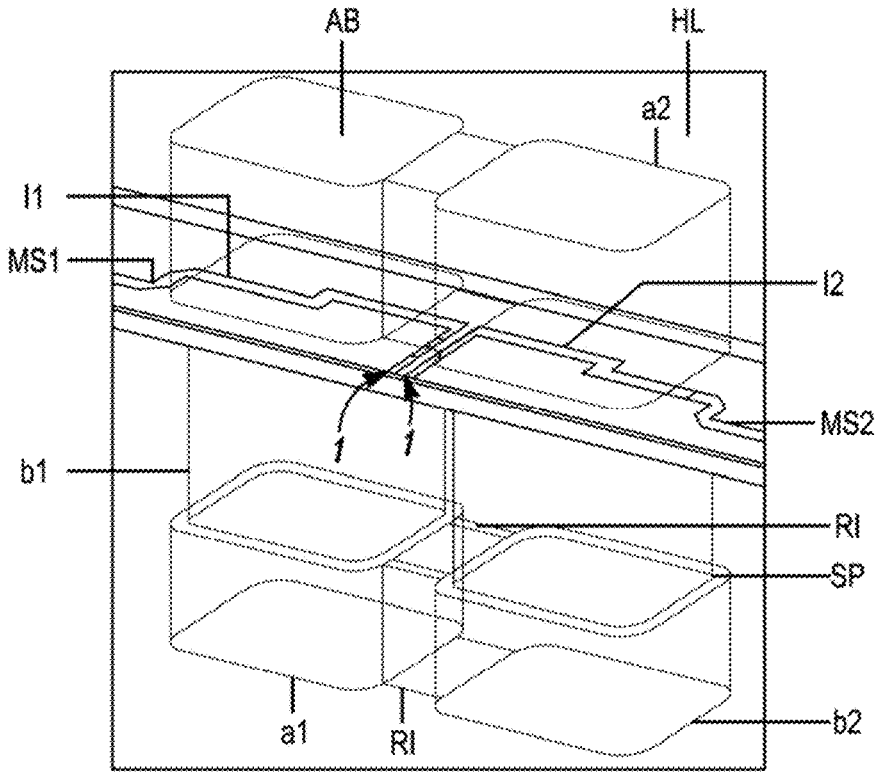
FIG. 6 shows a cross section of a ridge waveguide.

FIG. 6 shows an alternative waveguide shape compared to the otherwise rectangular waveguide HL as in FIG. 1. The waveguide HL is provided as a ridge waveguide in each case with a restriction RI in the center in the broad sides a1, a2. As a result, the waveguide HL becomes more broad-band.

Moreover, the ridge waveguide HL has a width change SP, in which the dimensions of the narrow sides b1, b2 and broad sides a1, a2 change in jumps and a length of the restriction RI is changed. This is used to minimize the reflections.

These modifications of the waveguide geometry are used according to FIG. 6 at the transition to the microstrip conductors MS1, MS2 and thus have an effect on the waveguide space close to the short-circuits 1 of conductor loops /1, /2 of the microstrip conductors MS1, MS2 with the waveguide HL. However, alternatively or additionally it is also possible to use this waveguide geometry in a waveguide network in other sections of the feed network.

Figure 7:
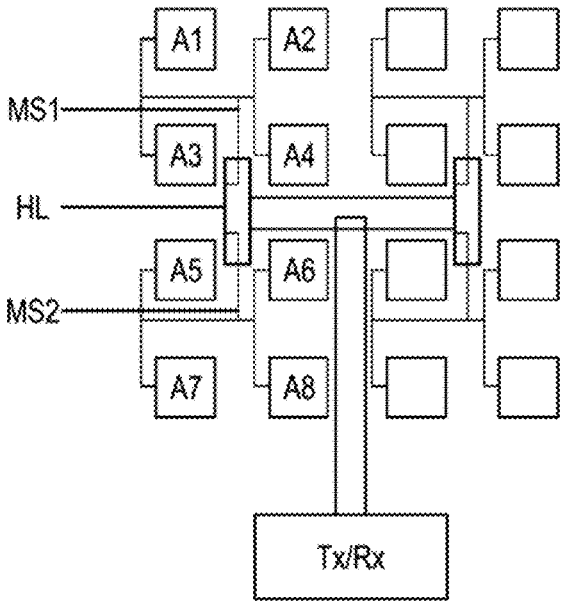
FIG. 7 shows an antenna with several horn radiators and a feed network.

The feed network according to the present disclosure is used, in particular, in antennas with several horn radiators as antenna elements. FIG. 7 in this context shows an antenna with 16 antenna elements, wherein a feed network alone is capable of feeding 8 antenna elements A1, A2, A3, A4, A5, A6, A7, and A8. A waveguide HL for that purpose is arranged centrally within eight antenna elements A1 to A8, and, on the two narrow sides, the signals are decoupled in two microstrip conductors MS1 and MS2. These microstrip conductors MS1, MS2 again form microstrip conductor networks, which in each case connect 4 antenna elements A1 to A4 or A5 to A8 to the waveguide HL. The waveguide HL in turn forms the termination of a waveguide network. Here, only one waveguide power divider is represented. The waveguide network itself is connected to a transmission and receiving device Tx/Rx which receives corresponding signals from the antenna or sends said signals to the antenna.

The feed network represented here makes it possible to feed a large number of antenna elements with a minimum of power dividers in the waveguide network. As a result, light-weight compact antennas can be produced, as are needed in the aircraft-based satellite communication in the X, Ku or Ka band.

Figure 11:
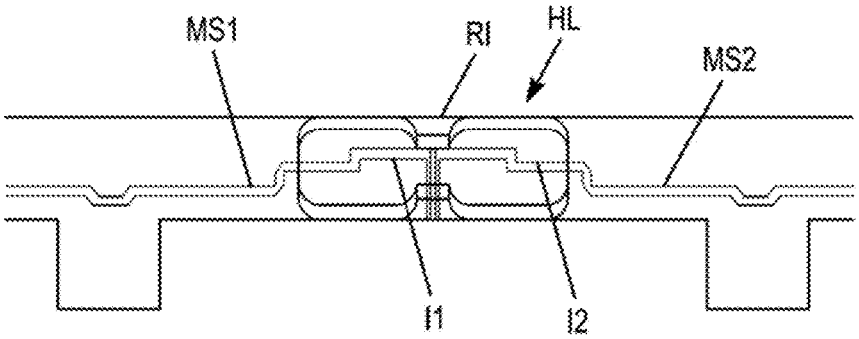
Figure 12:
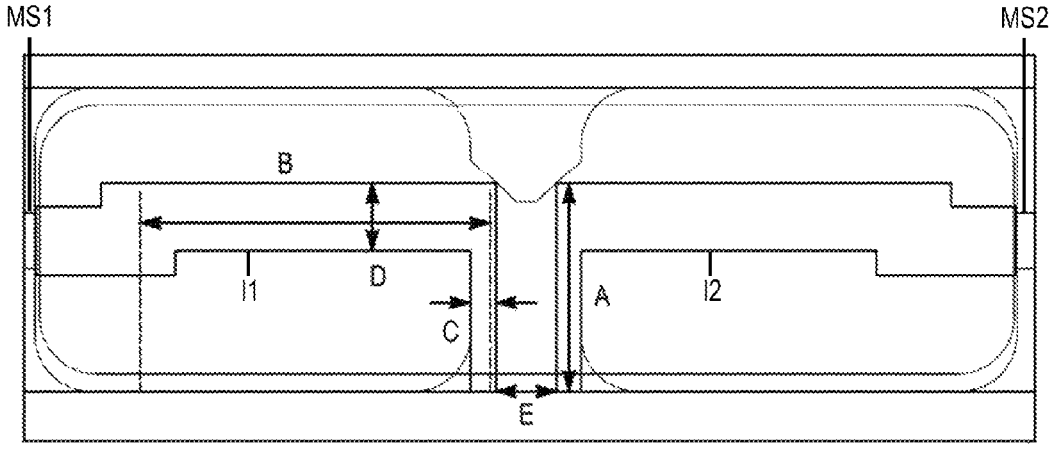
Figure 13:
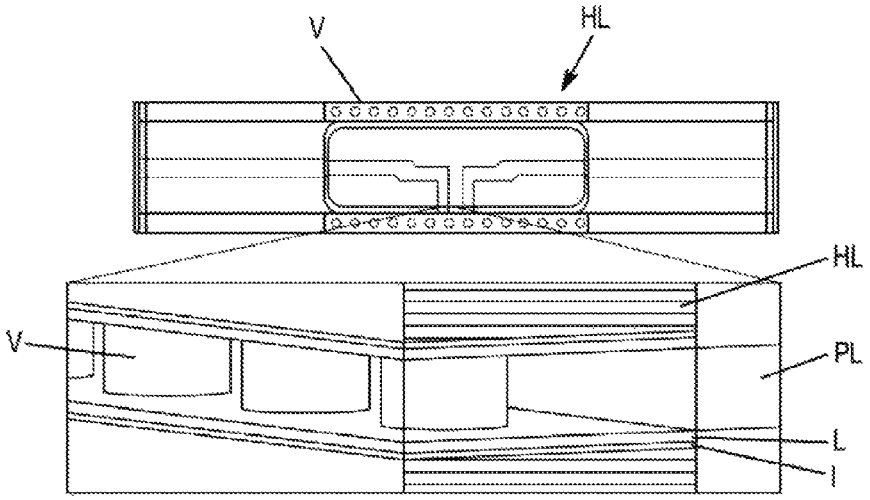

Based on FIGS. 8 to 13, alternative embodiment examples of the feed networks according to the present disclosure are shown, which, with the exception of the embodiment according to FIG. 13, comprise ridge waveguides with restrictions RI.

Figure 8:
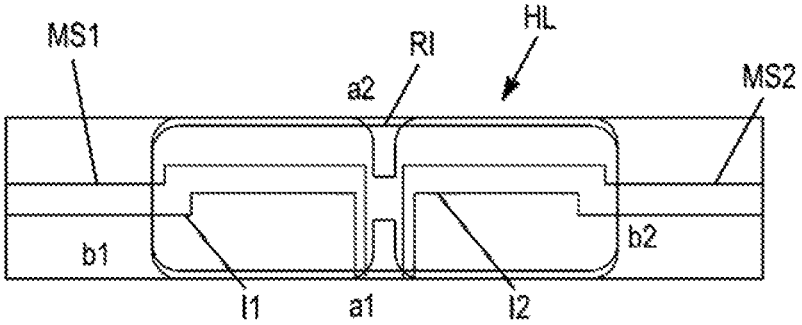
FIGS. 8 to 13 show feed networks with different divider ratios and the use of ridge waveguides and capacitive short-circuits.

FIG. 8 here shows a symmetric power divider (power decoupling 50%/50%), wherein the electrical connection of the conductor loops /1, /2 occurs just to the right and left of the restriction RI of the waveguide HL. The waveguide HL is shown having broad sides a1, a2 and narrow sides b1, b2. The two conductor loops /1, /2 frame the same surface area and have equal widths of the conductor paths.

Figure 9:
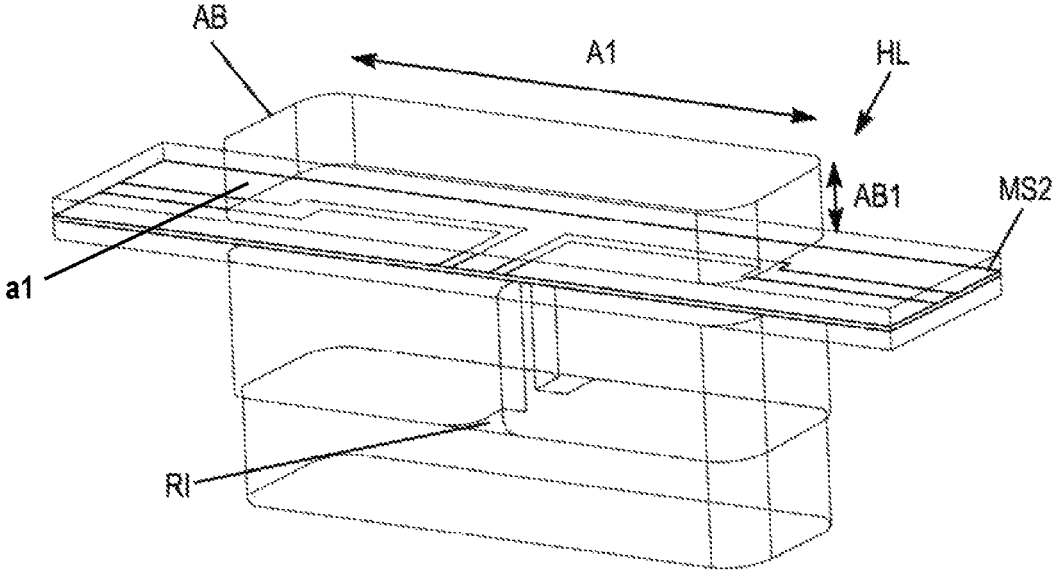

The feed network according to FIG. 9 is particularly suitable for small frequency bands, for example, in the X band. A distance AB1 from an end of the waveguide HL to the microstrip conductor is only approximately $\lambda/10$, that is clearly less than M4 or half the length A1 of the broad side a1. As a result, the installation size of the feed network is reduced once again.

Figure 10:
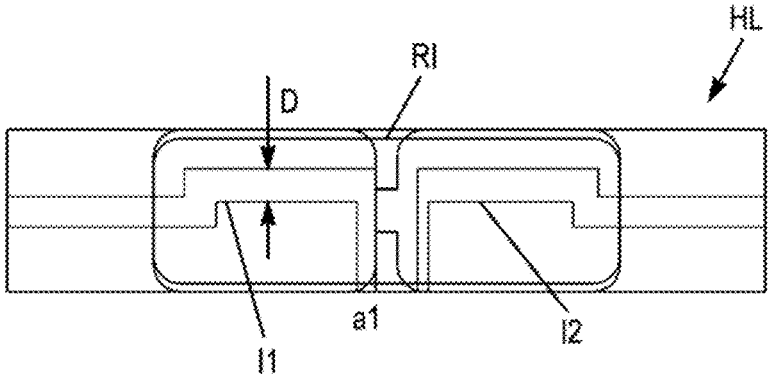

FIGS. 10 and 11 show asymmetric dividers with a divider ratio of about 66.7%/33.3% or 57%/43%, which is set in that the left conductor loop /1 encloses a larger surface area than the right conductor loop /2. In these feed networks as well, the galvanic electric connection between conductor loop /1, /2 and waveguide HL occurs without contacting with the restriction RI, in a rectilinear area of the waveguide HL. This is illustrated in FIG. 9. The restriction RI (viewed from the top end of the waveguide HL), starts only shortly after the microstrip conductor MS2 (see FIG. 11). As can be seen in FIG. 10, the width D of the left conductor loop /1 with the larger power decoupling is greater than the width of the right conductor loop /2. As a result, the left conductor loop /1 has a lower impedance than the right conductor loop /2 and is satisfactorily matched.

According to the present disclosure, the surface area set for the power division is determined substantially by the length A of the first line section from the short-circuit and the length B of the second line section in the direction of the narrow waveguide side, which frames the respective line loop /1, /2, as shown in FIG. 12. Moreover, for a low-reflection adaptation of the microstrip conductors MS1, MS2, remaining dimensions C, D, E of the conductor loops /1, /2, as shown in FIG. 12, also need to be considered. The width C of the first line section, the width D of the second line section are selected in accordance with the impedance of the conductor loop that is required for a low-reflection adaptation. The conductor loop with the larger power decoupling, according to the designations in FIG. 12, has a larger widths C, D of the microstrip line than the other conductor loop with the lower power decoupling—see FIG. 10.

In addition to the above-shown galvanic connection of conductor loop /1, /2 to the waveguide HL, a capacitive connection is also possible. In the case of a capacitive connection according to FIG. 13, the waveguide HL contains an opening into which a printed circuit board PL with conductor paths L forming the conductor loops on the surface is inserted. For the formation of a capacitance, the conductor paths L of the two sides of the printed circuit board PL are connected to one another by means of vias V. In the inserted state, waveguide HL and conductor paths L are separated by insulation I. The insulation I is formed by an electrically insulating coating, for example, a solder resist. The conductor paths L are built up from copper, and the waveguide HL from aluminum.

The figures are only schematic representations and are provided only for explaining the present disclosure. Like elements are uniformly denoted by like reference numerals.

LIST OF REFERENCE NUMERAL

Waveguide HL
Broad side a1, a2
Narrow side b1, b2
Microstrip conductor MS1, MS2
Conductor loop /1, /2
Midpoint of the broad side
Phase equalization arc
Antenna element A1 . . . A8
End of the waveguide AB
Transmission and receiving devices Tx/Rx
Short-circuit 1
Restriction RI
Width change SP
Length of the first line section from the short-circuit A
Length of the second line section in the direction of the narrow waveguide side B
Width of the first line section C
Width of the second line section D
Distance between the two conductor loops E
Length broad side A1
Distance end of the waveguide to microstrip conductor AB1
Via V
Conductor path L
Insulation I
Printed circuit board PL

The invention claimed is:

1. An antenna comprising:
a plurality of antenna elements;
a waveguide having broad sides facing each other and narrow sides facing each other; and
a feed network connecting the antenna elements to the waveguide, the feed network including:
a first microstrip conductor including a first conductor loop; and
a second microstrip conductor including a second conductor loop,
wherein:
the first and second conductor loops each extend into the waveguide from one of the narrow sides and are each electrically coupled to one of the broad sides; and
the first and second microstrip conductors include suspended strip lines.

2. The antenna according to claim 1, wherein the antenna is configured to operate bidirectionally for vehicle-based satellite communication in an X, Ka, or Ku frequency band.

3. The antenna according to claim 1, wherein:
the plurality of antenna elements form a first group of antenna elements, and the feed network is a first feed network, the antenna further including:

a second group of antenna elements; and a second feed network connecting the second group of antenna elements to the waveguide.

4. A feed network for an antenna system having a waveguide, the waveguide having broad sides facing each other and narrow sides facing each other, the feed network comprising:

a first microstrip conductor including a first conductor loop; and a second microstrip conductor including a second conductor loop;

wherein:

the first and second conductor loops each extend into the waveguide from one of the narrow sides and are each electrically coupled to one of the broad sides, the first and second conductor loops having different surface areas.

5. A feed network for an antenna system having a waveguide, the waveguide having broad sides facing each other and narrow sides facing each other, the feed network comprising:

a first microstrip conductor including a first conductor loop; and a second microstrip conductor including a second conductor loop;

wherein:

the first and second conductor loops each extend into the waveguide from opposing narrow sides and are each electrically coupled to a respective one of the broad sides.

6. The feed network according to claim 5, wherein:

the first conductor loop includes a first inside part that is within the waveguide, the second conductor loop includes a second inside part that is within the waveguide, and a length of the first inside part approximately equals a length of the second inside part.

7. The feed network according to claim 5, wherein the first and second conductor loops extend into the waveguide at centers of opposing narrow sides.

8. The feed network according to claim 5, wherein:

the first conductor loop is coupled to the one of the broad sides at a first electrical connection location;

the second conductor loop is coupled to the one of the broad sides at a second electrical connection location; and a distance from the first electrical connection location to a midpoint of the one of the broad sides is shorter than a distance from the second electrical connection location to the midpoint.

9. The feed network according to claim 8, wherein the second microstrip conductor includes a phase equalization arc, such that a length of the second microstrip conductor approximately equals a length of the first microstrip conductor.

10. The feed network according to claim 5, wherein the first and second conductor loops are coupled to the same broad side.

11. The feed network according to claim 5, wherein each of the first and second conductor loops includes parts of different widths and stepped offsets.

12. The feed network according to claim 5, wherein the first and second microstrip conductors include suspended strip lines.

13. The feed network according to claim 12, wherein the first and second microstrip conductors include copper strips of a printed circuit board, the printed circuit board including a dielectric with a thickness of about 0.1 to 1 mm, and the copper strips having a thickness of about 15 to 50 μm and a width of about 0.2 to 3 mm.

14. The feed network according to claim 13, wherein the thickness of the dielectric is about 0.127 mm, the thickness of the copper strips is about 17.5 μm, and the width of the copper strips is about 0.5 mm.

15. The feed network according to claim 5, wherein the waveguide is part of a waveguide feed network connected to transmission and receiving devices.

16. The feed network according to claim 5, wherein the first and second conductor loops are coupled to the one of the broad sides galvanically or capacitatively.

17. The feed network according to claim 16, wherein:

the first and second conductor loops are coupled to the one of the broad sides capacitatively, the first and second conductor loops are formed on a printed circuit board inserted into an opening of the waveguide, each of the first and second conductor loops includes two conductor paths formed on two sides of the printed circuit board and connected to each other through vias, and the conductor paths are separated from the waveguide by an insulation.

18. The feed network according to claim 5, wherein:

the waveguide includes a ridge waveguide having a restriction connecting two waveguide parts, each of the waveguide parts including a rectilinear section, the first and second conductor loops extend into the two waveguide parts, respectively, and each of the first and second conductor loops is coupled to the one of the broad sides on the rectilinear section of the corresponding waveguide parts.

19. The feed network according to claim 5, wherein the first and second conductor loops have different surface areas.

20. The feed network according to claim 19, wherein the first microstrip conductor has a greater width than the second microstrip conductor, such that the first conductor loop has a greater power decoupling than the second conductor loop.

* * * * *